US008087392B2

(12) United States Patent
Swanbon et al.

(10) Patent No.: US 8,087,392 B2
(45) Date of Patent: Jan. 3, 2012

(54) VARIABLE VALVE ACTUATION SYSTEM

(75) Inventors: Bruce A. Swanbon, Tolland, CT (US); Brian L. Ruggiero, East Granby, CT (US); Richard E Vanderpoel, Bloomfield, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 702 days.

(21) Appl. No.: 12/155,243

(22) Filed: May 30, 2008

(65) Prior Publication Data

US 2008/0308055 A1 Dec. 18, 2008

Related U.S. Application Data

(60) Provisional application No. 60/924,850, filed on Jun. 1, 2007.

(51) Int. Cl.
*F01L 1/18* (2006.01)

(52) U.S. Cl. ..... 123/90.46; 123/90.16; 123/90.39

(58) Field of Classification Search ..... 123/90.39, 123/90.46, 90.43, 90.41, 90.45, 90.47, 90.61, 123/90.16, 90.12, 321
See application file for complete search history.

(56) References Cited

U.S. PATENT DOCUMENTS 5,233,951 A 8/1993 Hausknecht
5,645,031 A 7/1997 Meneely
5,829,397 A * 11/1998 Vorih et al. ..... 123/90.12
6,196,175 B1 3/2001 Church
6,213,091 B1 4/2001 Haugen
6,267,098 B1 * 7/2001 Vanderpoel ..... 123/321
6,688,266 B1 2/2004 Church et al.
6,694,933 B1 2/2004 Lester
7,156,062 B2 * 1/2007 Vanderpoel ..... 123/90.59
2003/0221644 A1 12/2003 Barnes et al.
2003/0221663 A1 * 12/2003 Vanderpoel et al. ..... 123/321
2005/0211206 A1 9/2005 Ruggiero et al.
2005/0229888 A1 10/2005 Vanderpoel
2005/0274341 A1 12/2005 Usko
2006/0185635 A1 8/2006 Manole et al.
2007/0062193 A1 3/2007 Weber

* cited by examiner

*Primary Examiner* — Thomas Denion
*Assistant Examiner* — Daniel Bernstein
(74) *Attorney, Agent, or Firm* — David R. Yohannan; Kelley Drye & Warren LLP

(57) ABSTRACT

A variable valve actuation system to actuate and control the seating velocity of an internal combustion engine valve is disclosed. The system may comprise a rocker arm that includes first, second and third contact surfaces. The first contact surface may contact the engine valve. A hydraulic lost motion system may contact the rocker arm at the second contact surface, and a mechanical valve train element may contact the rocker arm at the third contact surface. The lost motion system may include a slave piston with a valve seating device incorporated therein. The lost motion system and the mechanical valve train element may be provided side by side at the end of the rocker arm opposite that of the engine valve.

26 Claims, 8 Drawing Sheets

VARIABLE VALVE ACTUATION SYSTEM

CROSS-REFERENCE TO RELATED APPLICATIONS

The present application relates to, and claims the priority of, U.S. Provisional Patent Application Ser. No. 60/924,850 filed Jun. 1, 2007, which is entitled "Variable Valve Actuation System".

FIELD OF THE INVENTION

The present invention relates generally to systems and methods for controlling engine combustion chamber valves in an internal combustion engine. In particular, the present invention relates to systems and methods for providing variable valve actuation of one or more engine valves.

BACKGROUND OF THE INVENTION

Engine combustion chamber valves, such as intake and exhaust valves, are typically spring biased toward a valve closed position. In many internal combustion engines, the engine valves may be opened and closed by fixed profile cams in the engine. More specifically, valves may be opened or closed by one or more fixed lobes which may be an integral part of each of the cams. In some cases, the use of fixed profile cams may make it difficult to adjust the timings and/or amounts of engine valve lift. It may be desirable, however, to adjust valve opening times and lift for various engine operating conditions, such as different engine speeds.

A method of adjusting valve timing and lift, given a fixed cam profile, has been to incorporate a "lost motion" device in the valve train linkage between the valve and the cam. Lost motion is the term applied to a class of technical solutions for modifying the valve motion dictated by a cam profile with a variable length mechanical, hydraulic, or other linkage means. The lost motion system comprises a variable length device included in the valve train linkage between the cam and the engine valve. The lobe(s) on the cam may provide the "maximum" (longest dwell and greatest lift) motion needed for a range of engine operating conditions. When expanded fully, the variable length device (or lost motion system) may transmit all of the cam motion to the valve, and when contracted fully, transmit none or a reduced amount of cam motion to the valve. By selectively decreasing the length of the lost motion system, part or all of the motion imparted by the cam to the valve can be effectively subtracted or lost.

Hydraulic-based lost motion systems may provide a variable length device through use of a hydraulically extendable and retractable piston assembly. The length of the device is shortened when the piston is retracted into its hydraulic chamber, and the length of the device is increased when the piston is extended out of the hydraulic chamber. One or more hydraulic fluid control valves may be used to control the flow of hydraulic fluid into and out of the hydraulic chamber.

One type of lost motion system, known as a Variable Valve Actuation (VVA) system, may provide multiple levels of lost motion. Hydraulic VVA systems may employ a high-speed control valve to rapidly change the amount of hydraulic fluid in the chamber housing the hydraulic lost motion piston(s). The control valve may also be capable of providing more than two levels of hydraulic fluid in the chamber, thereby allowing the lost motion system to attain multiple lengths and provide variable levels of valve actuation.

Typically, engine valves are required to open and close very quickly, and therefore the valve return springs are generally relatively stiff. If left unchecked after a valve opening event, the valve return spring could cause the valve to impact its seat with sufficient force to cause damage to the valve and/or its seat. In valve actuation systems that use a valve lifter to follow a cam profile, the cam profile provides built-in valve closing velocity control. The cam profile may be formed so that the actuation lobe merges gently with cam base circle, which acts to decelerate the engine valve as it approaches its seat.

In hydraulic lost motion systems, and in particular VVA hydraulic lost motion systems, rapid draining of fluid from the hydraulic circuit may prevent the valve from experiencing the valve seating provided by a cam profile. In VVA systems, for example, an engine valve may be closed at an earlier time than that provided by the cam profile by rapidly releasing hydraulic fluid from the lost motion system. When fluid is released from the lost motion system, the valve return spring may cause the engine valve to "free fall" and impact the valve seat at an unacceptably high velocity. The valve may impact the valve seat with such force that it eventually erodes the valve or valve seat, or even cracks or breaks the valve. In such instances, engine valve seating velocity may be limited by controlling the release of hydraulic fluid from the lost motion system instead of by a fixed cam profile. Accordingly, there is a need for valve seating devices in engines that include lost motion systems, and most notably in VVA lost motion systems.

In order to avoid a damaging impact between the engine valve and its seat, the valve seating device should oppose the closing motion regardless of the position of other valve train elements. In order to achieve this goal, the point at which the engine valve experiences valve seating control should be relatively constant. In other words, the point during the travel of the engine valve at which the valve seating device actively opposes the closing motion of the valve should be relatively constant for all engine operating conditions. Accordingly, it may be advantageous to position the valve seating device such that it can oppose the closing motion of the engine valve without regard to the position of intervening valve train elements, such as rocker arms, push tubes, or the like.

The valve seating device may include hydraulic elements, and thus may need to be supported in a housing and require a supply of hydraulic fluid, yet at the same time fit within the packaging limits of a particular engine. It may also be advantageous to locate the valve seating device near other hydraulic lost motion components. By locating the valve seating device near other lost motion components, housings, hydraulic feeds, and/or accumulators may be shared, thereby reducing bulk and the number of required components.

A valve seating device may be constructed so that a significant portion of the opposing force it applies to a closing engine valve occurs during the last millimeter of travel of the valve. As a result, control of the amount of lash space between the valve seating device and the engine valve or other intervening elements may be critical to proper operation of the valve seating device. Factors such as component thermal growth, valve wear, valve seat wear, and tolerance stack-up can affect the amount of lash. Some known valve seating devices have required manual lash adjustment or a separate set of lash adjustment hardware. Accordingly, it may be advantageous to have a valve seating device that self-adjusts for lash differences between the engine valve and the valve seating device.

Various embodiments of the present invention may meet one or more of the aforementioned needs and provide other benefits as well.

SUMMARY OF THE INVENTION

Applicant has developed an innovative valve actuation system for actuating at least one engine valve in an internal combustion engine with valve seating control, said system comprising: a rocker arm having a first contact surface at a first end, and having a second contact surface and a third contact surface at a second end; an engine valve operatively contacting the first contact surface; a valve train element operatively contacting the second contact surface; a housing; a lost motion system disposed in said housing, said lost motion system including a slave piston operatively contacting the third contact surface; and a valve seating device provided in said lost motion system.

Applicant has further developed an innovative system for actuating at least one engine valve in an internal combustion engine, said system comprising: a rocker arm having a first contact surface at a first end, and having a second contact surface and a third contact surface at a second end; an engine valve operatively contacting the first contact surface; a first valve train element operatively contacting the second contact surface; and a lost motion system including a master piston and a slave piston operatively contacting the third contact surface.

It is to be understood that both the foregoing general description and the following detailed description are exemplary and explanatory only, and are not restrictive of the invention as claimed. The accompanying drawings, which are incorporated herein by reference, and which constitute a part of specification, illustrate certain embodiments of the invention and, together with the detailed description, serve to explain the principles of the present invention.

BRIEF DESCRIPTION OF THE DRAWINGS

In order to assist in the understanding of the invention, reference will now be made to the appended drawings, in which like reference characters refer to like elements. The drawings are exemplary only, and should not be construed as limiting the invention.

DETAILED DESCRIPTION OF PREFERRED EMBODIMENTS OF THE INVENTION

Figure 1:
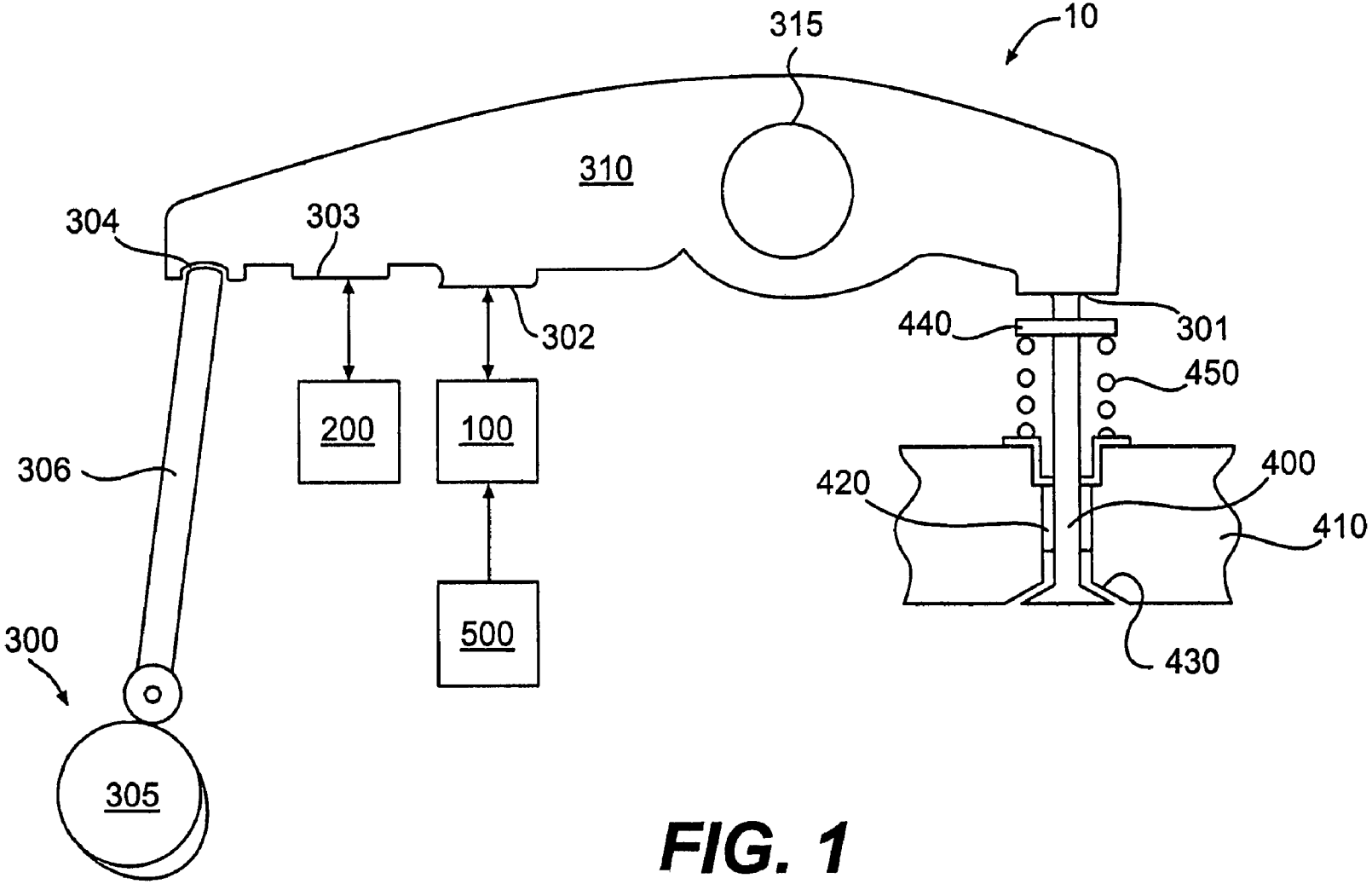
FIG. 1 is a schematic diagram of an engine valve actuation system in accordance with a first embodiment of the present invention.

Reference will now be made in detail to a first embodiment of a valve actuation system 10 of the present invention, an example of which is illustrated schematically in FIG. 1. The system 10 may include a rocker arm 310 operatively connected to one or more valve train elements 300, a lost motion system 100, a valve seating device 200, and at least one engine valve 400. The lost motion system 100 may receive an input from a motion imparting means 500, such as a cam. The rocker arm 310 may transmit a valve actuation motion to the engine valve 400 from either or both of the valve train elements 300 and the motion imparting means 500. The engine valve 400 may be an intake, exhaust or auxiliary engine valve actuated to produce various engine valve events, such as, but not limited to, main intake, main exhaust, compression release braking, bleeder braking, exhaust gas recirculation, early or late exhaust valve opening and/or closing, early or late intake opening and/or closing, centered lift, etc.

The motion imparting means 500 may comprise any combination of cam(s), push-tube(s), rocker arm(s) or other mechanical, electro-mechanical, hydraulic, or pneumatic device for imparting a linear actuation motion. The motion imparting means 500 may receive motion from an engine component and transfer the motion as an input to the lost motion system 100.

The lost motion system 100 may comprise any structure that connects the motion imparting means 500 to the rocker arm 310 and which is capable of selectively losing part or all of the motion imparted to it by the motion imparting means 500. The lost motion system 100 may comprise, for example, a variable length mechanical linkage, hydraulic circuit, hydro-mechanical linkage, electro-mechanical linkage, and/or any other linkage provided between the motion imparting means 500 and the rocker arm 310 and adapted to attain more than one operative length. If the lost motion system 100 incorporates a hydraulic circuit, it may include means for adjusting the pressure or the amount of fluid in the hydraulic circuit, such as, for example, trigger valve(s), check valve(s), accumulator(s), and/or other devices used to release hydraulic fluid from, and/or add hydraulic fluid to, a hydraulic circuit. The lost motion system 100 may contact the rocker arm 310 at a first contact point 302.

The engine valve 400 may be disposed within a sleeve 420, which in turn is provided in a cylinder head 410. The engine valve 400 may be adapted to slide up and down relative to the sleeve 420 and may be biased into a closed position by a valve spring 450. The valve spring 450 may be compressed between the cylinder head 410 and a valve spring retainer 440 that may be attached to the end of a valve stem, thereby biasing the engine valve 400 into an engine valve seat 430. When the engine valve 400 is in contact with the engine valve seat 430, the engine valve 400 is effectively in a closed position. The engine valve 400 may contact the rocker arm 310 at a second contact point 301.

The valve train elements 300 may include one or more mechanical elements such as a cam 305 and a push tube 306 which are adapted to transfer a valve actuation motion to the rocker arm 310. The valve train elements 300 may contact the rocker arm 310 at a third contact point 304.

The rocker arm 310 may be disposed pivotally on a shaft 315. The rocker arm 310 may pivot about the shaft 315 so as to transmit motion from one side of the pivot point to the other. In this manner the rocker arm may receive independent actuation motions from the lost motion system 100 and the valve train elements 300, and may transfer these motions to the engine valve 400. The rocker arm 310 may also transmit the force of the valve spring 450 that biases the engine valve 400 towards a closed position back to the lost motion system 100, valve train elements 300, and the valve seating device 200.

The valve seating device 200 may be operatively connected to the rocker arm 310 at a fourth contact point 303. The valve seating device 200 may provide resistance to the bias of the engine valve spring 450 through the rocker arm 310. In a preferred embodiment, the valve seating device 200 is constantly activated. It is contemplated, however, that the valve seating device 200 may be deactivated when a user desires, so that it does not operate to seat the engine valve 400. When the valve seating device 200 is deactivated, the engine valve 400 may seat under the bias of the engine valve spring 450, the control of the valve train elements 300, and/or the lost motion device 100.

When the lost motion system 100 is not activated to lose motion, motion may be transferred from both the valve train elements 300 and the motion imparting means 500 to the engine valve 400 through the rocker arm 310. Likewise, the force of the engine valve spring 450 may be transferred from the engine valve spring 450, through the rocker arm 310, to the lost motion system 100, the valve train elements 300, and the valve seating device 200. However, when the lost motion system 100 acts to lose the motion of the motion imparting means 500, the engine valve 400 normally may close in a "free-fall," a state in which the engine valve 400 may contact the engine valve seat 430 at an undesirably high rate of speed. In order to slow the velocity at which the engine valve 400 closes when the lost motion system 100 is losing motion, the valve seating device 200 may be used.

The valve seating device 200 may slow the speed at which the engine valve 400 contacts the engine valve seat 430 by opposing the motion of the engine valve 400 through the rocker arm 310. The valve seating device 200 may slow the seating velocity of the engine valve 400, preferably in a progressive manner, and particularly in the last millimeter of travel, thereby reducing the wear and damage on both the engine valve 400 and the engine valve seat 430.

It should be appreciated that the schematic arrangement of the lost motion system 100, valve seating device 200 and valve train elements 300 relative to the rocker arm 310 in FIG. 1 is not intended to be limiting. These three elements need not be longitudinally spaced apart at one end of the rocker arm 310 as shown in FIG. 1, but may be arranged in a different order or disposed laterally. Moreover, one or more of these three elements may, in an alternative embodiment, act on the upper side of the rocker arm at or near the end of the rocker arm that contacts the engine valve 400.

Figure 2:
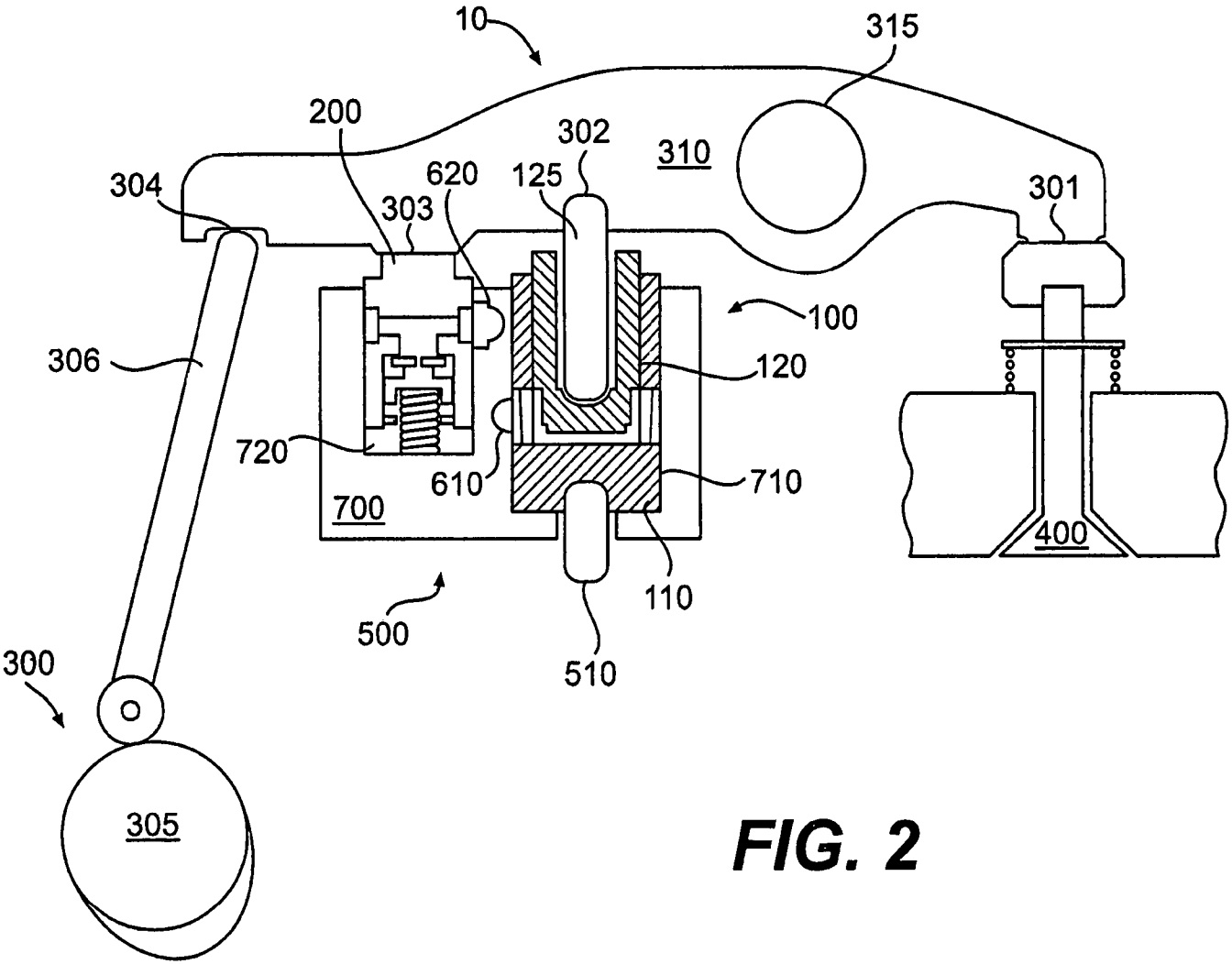
FIG. 2 is a schematic diagram of an engine valve actuation system in accordance with a second embodiment of the present invention.

A second embodiment of the present invention is illustrated schematically in FIG. 2, in which like reference characters refer to like elements. The lost motion system 100 and the valve seating device 200 may be disposed in a housing 700. In one embodiment, the lost motion system 100 may comprise a collapsible tappet assembly having a master piston 110 and a slave piston 120. In alternative embodiments, the master piston and slave piston may be provided separately and connected by a hydraulic passage extending through the housing 700.

With continued reference to FIG. 2, the master piston 110 may be slidably disposed in a bore 710 formed in the housing 700 such that it may slide back and forth in the bore 710 while maintaining a hydraulic seal with the housing 700. The slave piston 120 may be slidably disposed within the master piston 110 such that it may slide relative to the bore 710 while maintaining a hydraulic seal with the master piston 110. Hydraulic fluid may be selectively supplied to the lost motion system 100 between master piston 110 and the slave piston 120 through a passage 610.

In the embodiment of the present invention shown in FIG. 2, the slave piston 120 may further include an extension 125 having a first end contacting the slave piston 120 and a second end contacting the second contact surface 302 of the rocker arm 310. Alternatively, it is contemplated that the slave piston 120 may contact the rocker arm 310 directly. Other suitable means for supplying motion to the rocker arm 310 through the lost motion system 100 are considered well within the scope and spirit of the present invention.

In the embodiment of the present invention shown in FIG. 2, the motion imparting means 500 may include a push tube assembly 510. The push tube assembly 510 may contact and impart motion to one end of the master piston 110. The push tube 510 may receive engine valve actuation motion from one or more cams (not shown). In an alternative embodiment, the cam may act directly on the master piston 110 without the push tube 510.

A control circuit 600 element, such as, for example, a trigger valve (not shown) may be disposed in or adjacent the housing 700 and connected to the passage 610. When motion transfer is required, the trigger valve may be closed such that fluid is trapped between the master piston 110 and the slave piston 120, creating a hydraulic lock. At such times, motion from the pushtube 510 is transmitted through the master piston 110 and the slave piston 120 to the rocker arm 310, which, in turn, causes the engine valve 400 to open. When motion transfer is not required, the trigger valve may be opened and fluid is permitted to flow in and out of the space between the master piston 110 and the slave piston 120. All, or a portion of, the motion applied to the master piston 110 may then be "lost" in accordance with control over the trigger valve.

With continued reference to FIG. 2, the valve seating device 200 may be disposed in a second bore 720 provided in the housing 700, or alternatively, in a separate housing adjacent to the housing 700. A valve seating device 200 that is not integrated into the slave piston 120, such as that shown in FIG. 2, is referred to as an "external" valve seating device. In alternative embodiments, an "internal" valve seating device may be integrated into the slave piston. Hydraulic fluid may be supplied to the valve seating device via a hydraulic passage 620. Internal hydraulic passages between internal elements in the valve seating device 200 may throttle the flow of hydraulic fluid through the valve seating device such that return motion of the rocker arm 310 is resisted as the engine valve 400 is on the verge of being completely closed. As a result, the valve seating device may seat the engine valve 400 without undesirable impact against its valve seat.

Figure 3:
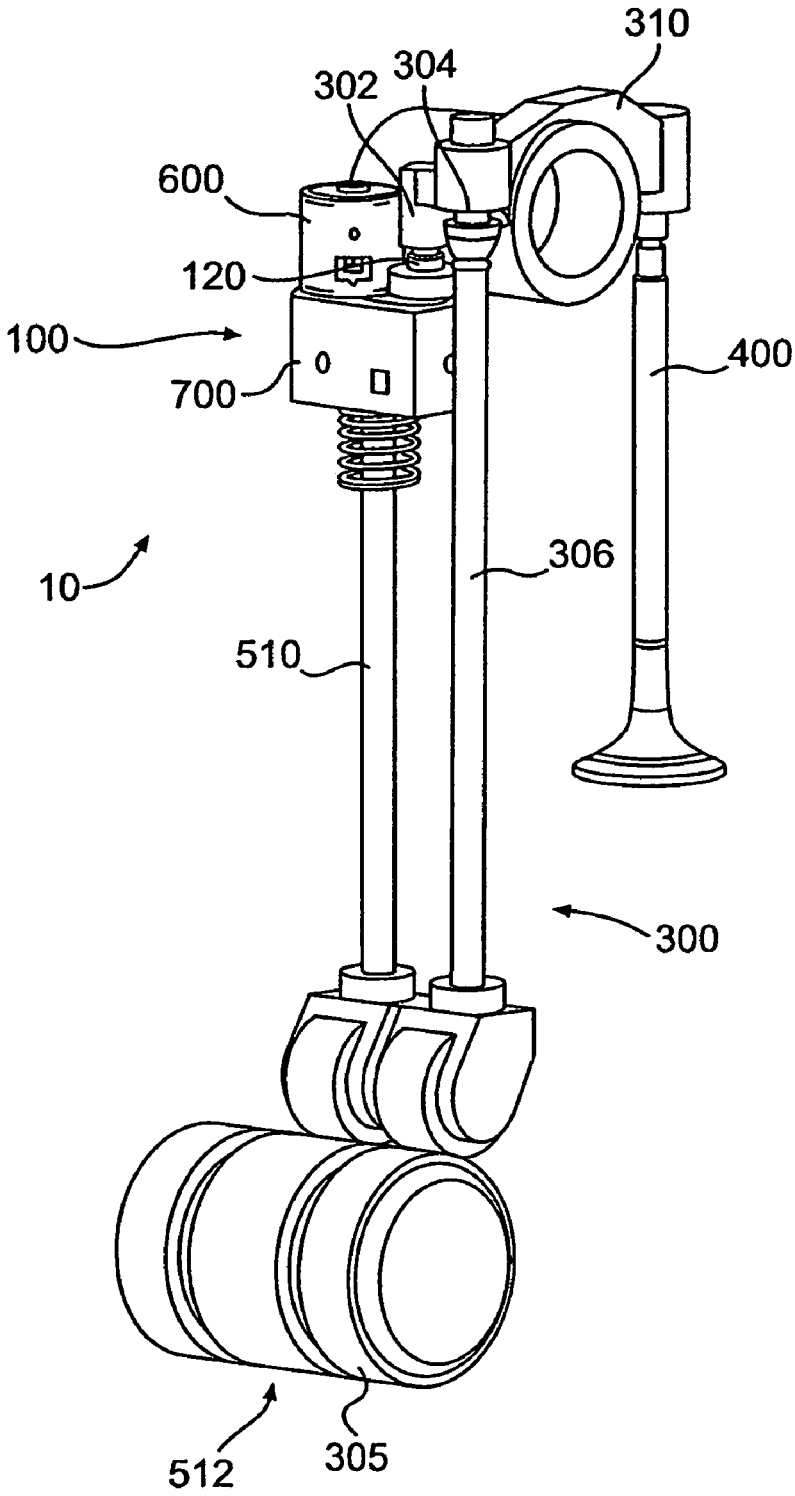
FIG. 3 is a pictorial view of an engine valve actuation system in accordance with a third embodiment of the present invention which includes a rocker arm actuated by both a conventional cam and push tube arrangement and by a cam, push tube and lost motion system arrangement.
Figure 4:
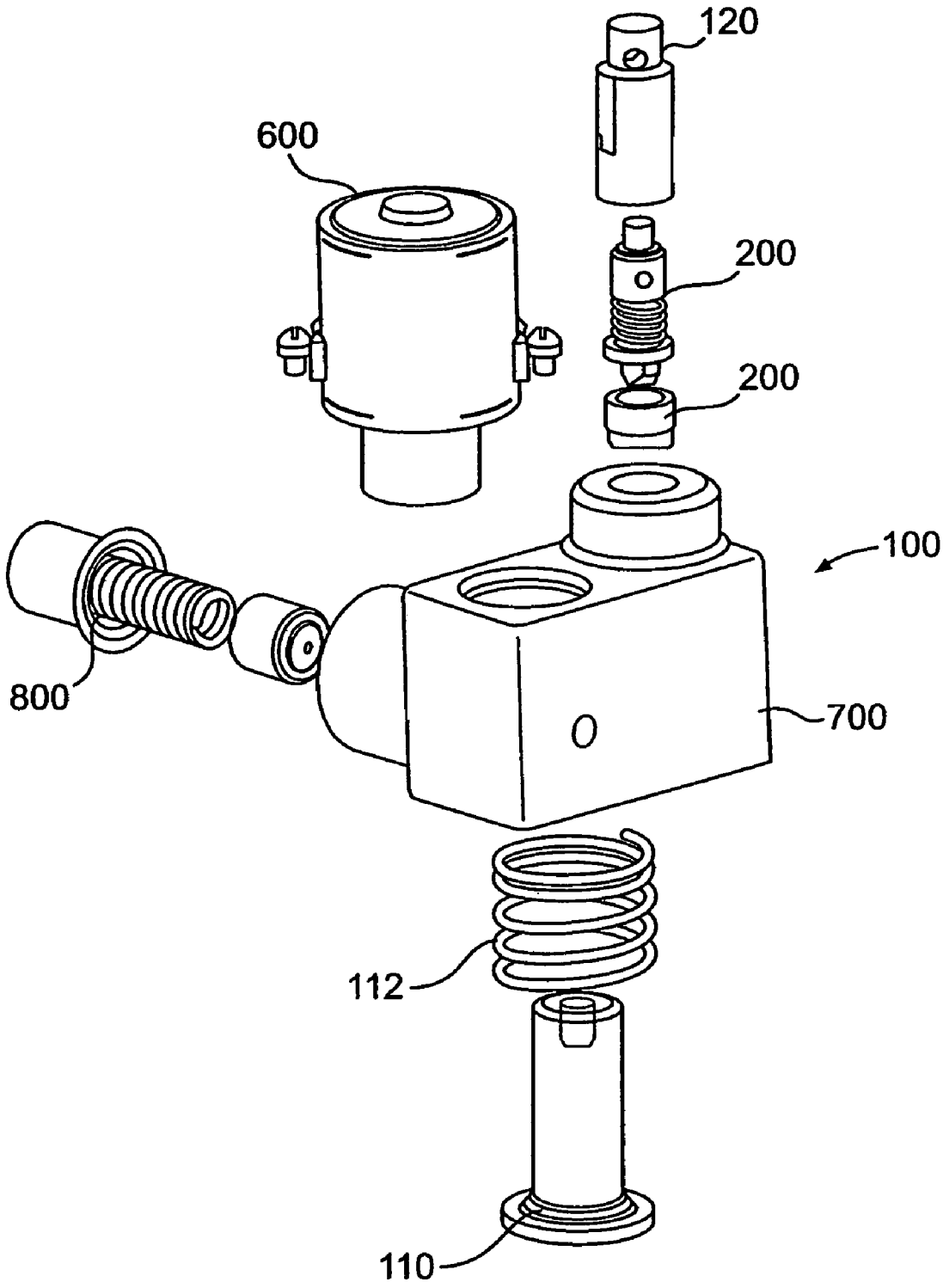
FIG. 4 is an exploded pictorial view of the lost motion system arrangement shown in FIG. 3 in accordance with an embodiment of the invention.
Figure 5:
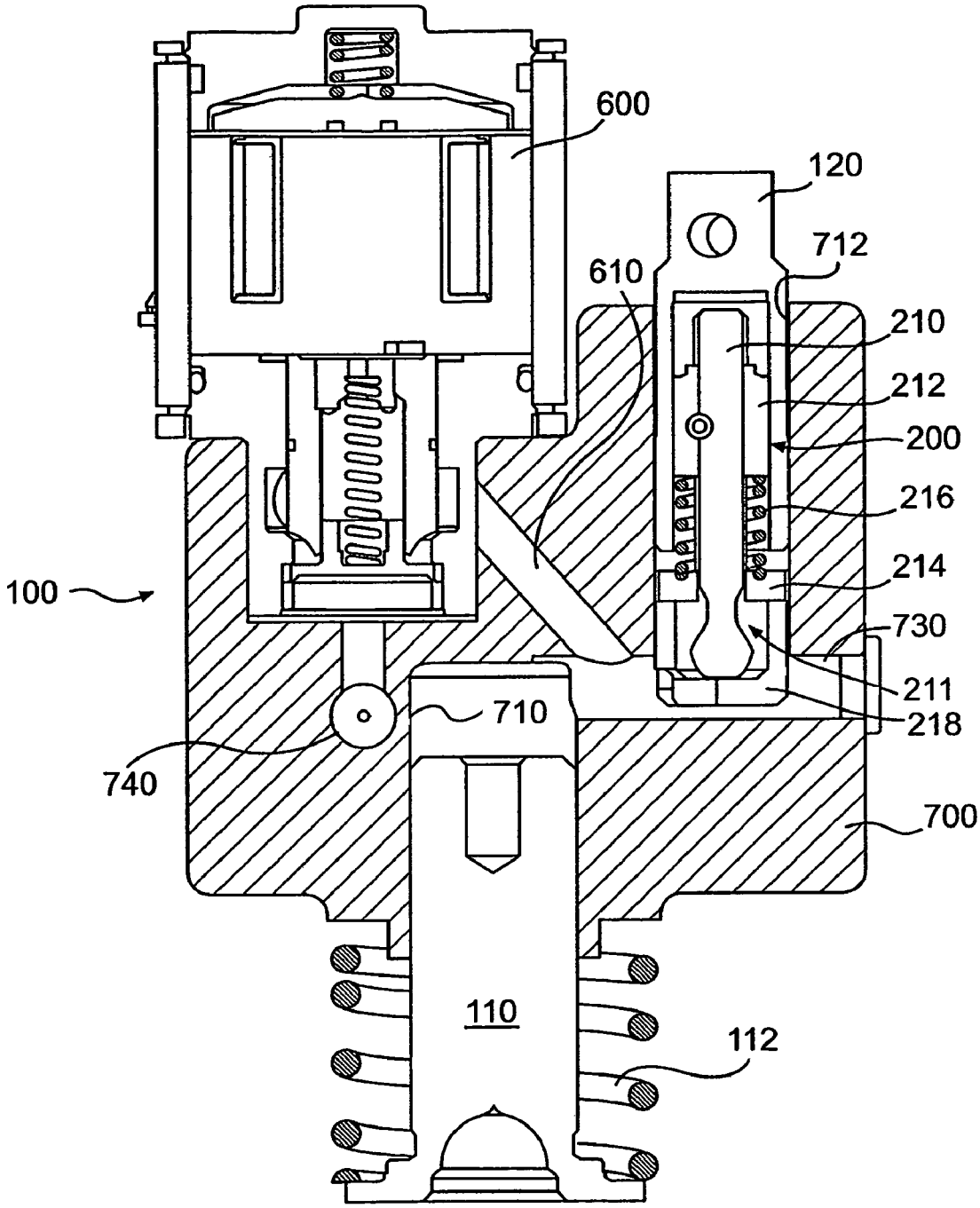
FIG. 5 is a cross-section detailed view of the lost motion system arrangement shown in FIGS. 3 and 4 which includes an internal valve seating device.

A third embodiment of the present invention is illustrated in FIGS. 3, 4 and 5, in which like reference characters refer to like elements. FIG. 3 is a pictorial view of the entire valve actuation system 10. FIG. 4 is an exploded pictorial view of the lost motion system 100 and the elements provided therein. FIG. 5 is a cross-sectional view of the lost motion system 100 and the elements provided therein.

With reference to FIGS. 3, 4 and 5, the rocker arm 310 is disposed between the engine valve 400 at one end and the valve train elements 300 and lost motion system 100 at the other end. The rocker arm 310 is provided with a contact point 302 for receiving motion from the lost motion system 100 and a contact point 304 for receiving motion from the valve train elements 300.

With continued reference to FIGS. 3, 4 and 5, the lost motion system 100 may include a housing 700 with several bores for receipt of the component parts of the lost motion system. A master piston 110 may be slidably disposed in a master piston bore 710 and biased out of the bore into contact with a push tube 510 by a master piston spring 112. A slave piston 120 may be slidably disposed in a slave piston bore 712. A sealed hydraulic passage 730 may extend between the master piston bore 710 and the slave piston bore 712.

The system 10 may further comprise a trigger valve 600 connected to the master-slave hydraulic passage 730 via a second hydraulic passage 610. The trigger valve 600 may selectively release hydraulic fluid from the lost motion system 100 by applying electrical control inputs to the trigger valve from an engine control module or other control unit (not shown). Depending on the engine operating mode, the trigger valve 600 may selectively activate the lost motion system 100. When the lost motion system 100 is deactivated, it may lose all of the motion received from the motion imparting means 500, and thus may not supply motion to the rocker arm 310 and therefore to the engine valve 400. When the lost motion system 100 is activated, it may transfer all or a portion of the motion received from the motion imparting means 500 to the rocker arm 310.

The trigger valve 600 may be connect to a hydraulic fluid accumulator 800 by a third hydraulic passage 740 provided in the housing 700. The accumulator may temporarily stored hydraulic fluid released from the master-slave passage 730 by the trigger valve 600 during operation of the lost motion system. Placement of the accumulator in close proximity to the master-slave passage 730 provides a ready supply of hydraulic fluid for recharging the master-slave passage 730 for subsequent lost motion engine valve actuation.

With reference to FIG. 5 in particular, the slave piston 120 may incorporate a valve seating device 200 within an interior opening provided in the slave piston. The valve seating device 200 may include a longitudinally extending pin 210 which is connected to a lash piston 212. The lash piston 212 may be sized to form a hydraulic seal with the interior surface of the slave piston 120 that is tight enough to prevent rapid flow of hydraulic fluid into and out of the upper portion of the slave piston, but not so tight that hydraulic fluid does not slowly fill this space. By providing the right amount of seal, hydraulic fluid may fill the space between the upper end of the lash piston 212 and the end of the slave piston 120 such that the valve seating device 200 automatically takes up any lash space between the slave piston and rocker arm 310.

With continued reference to FIG. 5, a lower end of the pin 210 may be in contact with a cup-shaped member 218 which may slide relative to the slave piston bore 712. The cup-shaped member 218 may include one or more openings near its lower end that permit the flow of hydraulic fluid between the master-slave passage 730 and the interior of the cup-shaped member. A seating disk 214 may be disposed about the pin 210 between the lash piston 212 and the cup-shaped member 218. The seating disk 214 may slide relative to the pin 210 and the slave piston bore 712. A seating spring 216 may be disposed between the guide member 212 and the seating disk 214 such that the seating disk is biased towards the cup-shaped member 214.

The lower end of the pin 210 may include one or more grooves or channels 211 which are designed to selectively register with the seating disk 214 during a valve seating event and permit the flow of hydraulic fluid past the seating disk and out of the bottom of the cup-shaped member 218. The seating disk 214 also may be sized so as to permit a small amount of hydraulic fluid to flow around its outer perimeter between the interior of the slave piston 120 and the cup-shaped member 218 during a valve seating event.

The lost motion system 100 including the valve seating device 200 shown in FIGS. 3, 4 and 5 may operate as follows. Hydraulic fluid may be provided to the master-slave hydraulic passage 730 via a hydraulic fluid supply connected to the trigger valve 600 or to the master-slave passage directly. Fluid supplied to the master-slave passage 730 may fill the space between the lash piston 212 and the cup-shaped member 218 and some fluid may leak past the seal formed between the lash piston 212 and the slave piston 120 into a lash space above the lash piston. The pressure created by the fluid above the lash piston 212 may cause the slave piston 120 to rise within the bore 712. This may cause the upper surface of the slave piston 120 to contact the rocker arm 310, taking up any lash that may exist between the valve seating device 200 and the rocker arm 310.

Once the master-slave passage is filled, a valve actuation motion may be transferred by the motion imparting means 500 to the master piston 110. The motion imparting means may, for example, include a cam 512 with one or more auxiliary valve actuation lobes and a push tube 510. If it is desired to close the engine valve 400 before the normal time dictated by the one or more auxiliary valve actuation lobes on the cam 512, the trigger valve 600 may be opened so as to release the high pressure hydraulic fluid in the master-slave passage 730 to the accumulator 800. Release of this high pressure hydraulic fluid may cause the slave piston 120 to rapidly collapse into the slave piston bore 712.

When the trigger valve 600 is opened, hydraulic fluid in the interior space of the slave piston 120 is initially free to flow past the seating disk 214 through the channels 211 in the lower end of the pin 210 and out of the cup-shaped member 218 towards the accumulator 800. Hydraulic fluid may also flow around the outer perimeter of the seating disk 214 to the extent that the seating disk is not yet pressed against the upper edge of the cup-shaped member 218. As the slave piston 120 collapses further, the cup-shaped member 218 may contact the bottom of the master-slave passage 730, and the slave piston 120 may contact the upper end of the pin 210. As a result, the pin 210 may be pushed downward relative to the seating disk 214 and the seating spring 216 may press the seating disk 214 into the cup-shaped member. When this happens, the channels 211 provided in the pin 210 begin to fall out of registration with the interior opening of the seating disk 214. The channels 211 may be tapered or otherwise shaped so that the flow of fluid through them is progressively throttled (i.e., cut off) as the pin 210 is pushed downwards. Furthermore, as the seating disk approaches the cup-shaped member 218, the flow of hydraulic fluid around the outer perimeter of the seating disk to the interior of the cup-shaped member is progressively cut off. These events progressively slow the flow of hydraulic fluid from the space between the slave piston 120 and the seating disk 214, which in turn slows velocity of the slave piston's collapse into the slave piston bore 712, and thus slows the seating velocity of the engine valve 400 as the slave piston 120 acts through the rocker arm 310.

The hydraulic fluid needed for subsequent lost motion valve actuation may be re-supplied to the master-slave passage 730 by opening the trigger valve when the auxiliary cam 512 is at base circle. At this time, hydraulic fluid in the accumulator, combined with fluid from the external supply, may charge the master-slave passage 730 for the next lost motion event.

Figure 6:
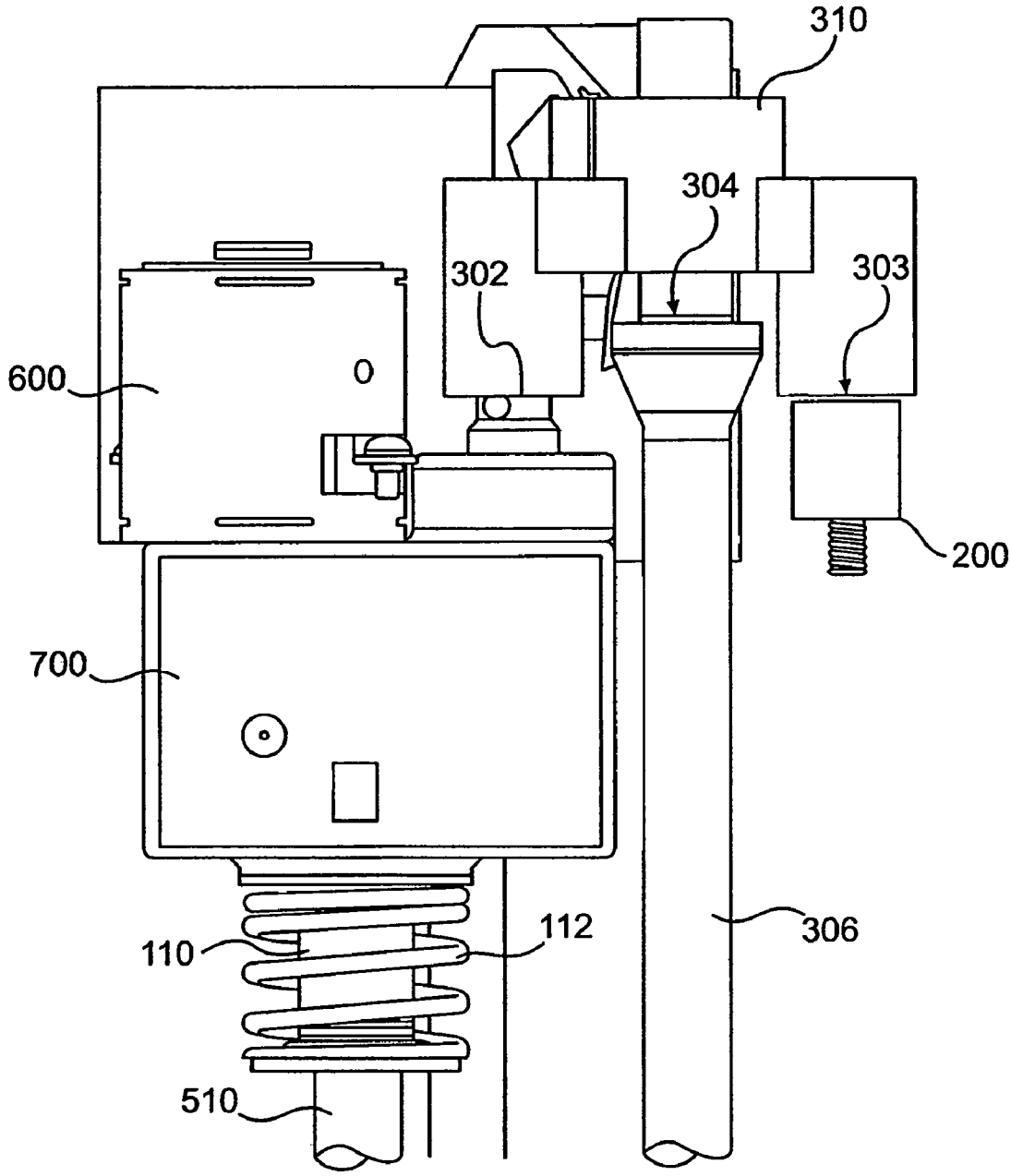
FIG. 6 is a side view of a lost motion system in accordance with an embodiment of the present invention which includes an external valve seating device.

An alternative embodiment of the valve actuation system 10 shown in FIGS. 3-5 is shown in FIG. 6, in which like reference characters refer to like elements. In the embodiment shown in FIG. 6, the valve seating device 200 is provided "externally" and separate from the slave piston 120.

Figure 8:
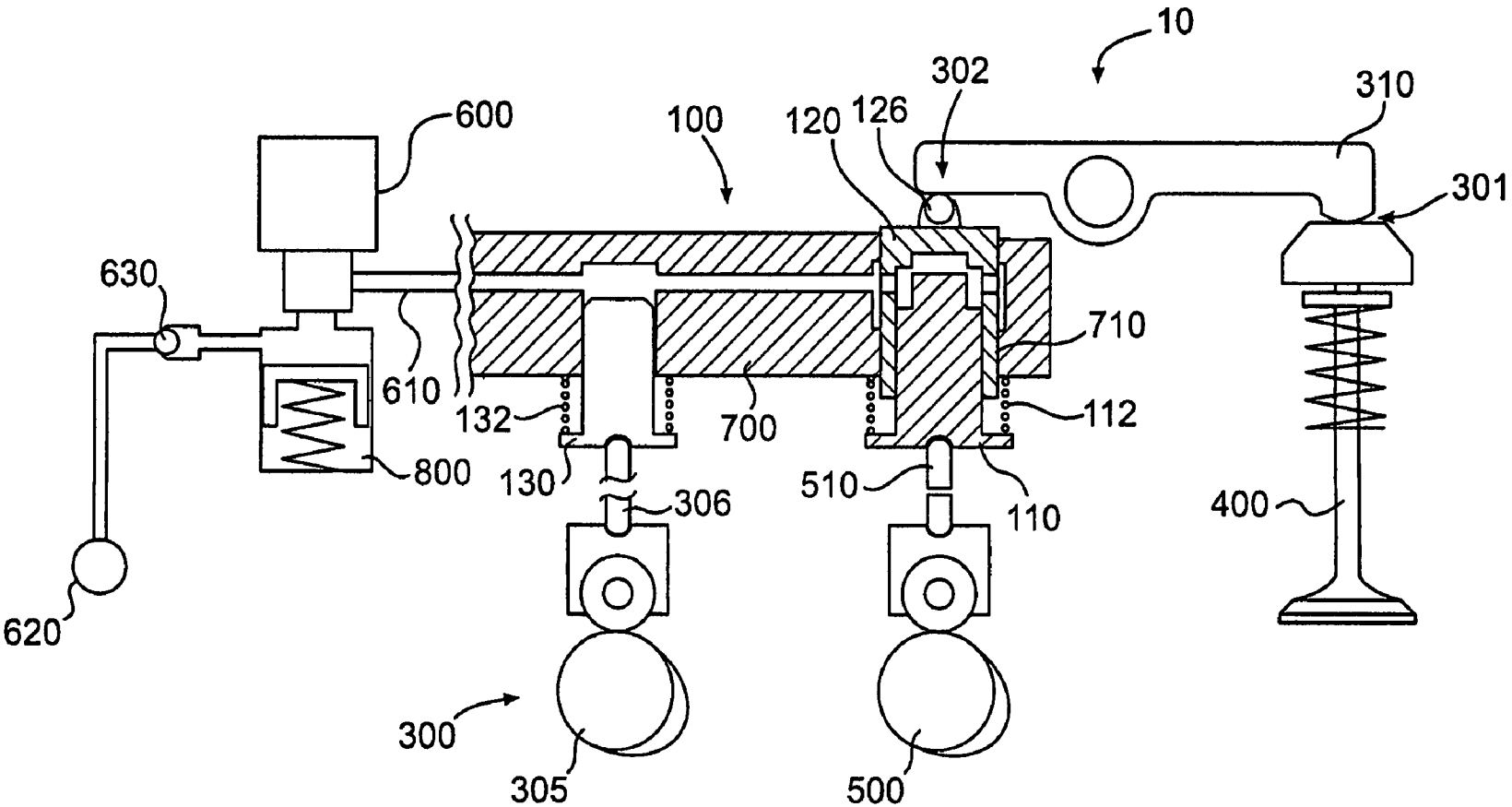
FIG. 8 is a schematic diagram of an engine valve actuation system in accordance with a fourth embodiment of the present invention.

Another embodiment of the present invention is illustrated schematically in FIG. 8, in which like reference characters refer to like elements. The lost motion system 100 may be disposed in a housing 700. In one embodiment, the lost motion system 100 may comprise a collapsible tappet assembly having a first master piston 110 and a slave piston 120 as well as a second master piston 130. In alternative embodiments, the first master piston 110 and the slave piston 120 may be provided separately and connected by a hydraulic passage extending through the housing 700.

With continued reference to FIG. 8, the first master piston 110 may be slidably disposed in a bore 710 formed in the housing 700 such that it may slide back and forth in the bore 710 while maintaining a hydraulic seal with the housing 700. The first master piston may be biased out of the bore 710 by a spring 112. The slave piston 120 may be slidably disposed within the first master piston 110 such that it may slide relative to the bore 710 while maintaining a hydraulic seal with the first master piston 110. Hydraulic fluid may be selectively supplied to the lost motion system 100 between the first master piston 110, the second master piston 130, and the slave piston 120 through a passage 610. A hydraulic fluid supply 620 may provide hydraulic fluid to the passage 610 through a check valve 630.

In the embodiment of the present invention shown in FIG. 8, the slave piston 120 may further include an elephant foot contact 126 having a first end contacting the slave piston 120 and a second end contacting the second contact surface 302 of the rocker arm 310. Alternatively, it is contemplated that the slave piston 120 may contact the rocker arm 310 directly. Other suitable means for supplying motion to the rocker arm 310 through the lost motion system 100 are considered well within the scope and spirit of the present invention.

In the embodiment of the present invention shown in FIG. 8, the motion imparting means 500, which may be a cam as shown, may include a push tube assembly 510. The push tube assembly 510 may contact and impart motion to one end of the first master piston 110. The push tube 510 may receive engine valve actuation motion from one or more cam lobes. In an alternative embodiment, the cam may act directly on the first master piston 110 without the push tube 510.

The second master piston 130 may also provide hydraulic force on the slave piston 120. The valve train elements 300 which may include one or more mechanical elements such as a cam 305 and a push tube 306 may be adapted to transfer a valve actuation motion to the second master piston 130. The second master piston 130 may be biased out of its bore by a spring 132.

A control circuit 600 element, such as, for example, a trigger valve may be disposed in or adjacent the housing 700 and connected to the passage 610. When motion transfer is required, the trigger valve may be closed such that fluid is trapped between the first master piston 110, the second master piston 130, and the slave piston 120, creating a hydraulic lock. At such times, motion from the pushtubes 510 and 306 are transmitted through the first and second master pistons 110 and 130 to the slave piston 120, to the rocker arm 310, which, in turn, causes the engine valve 400 to open. When motion transfer is not required, the trigger valve may be opened and fluid is permitted to flow in and out of the space between the first and second master pistons 110 and 130 and the slave piston 120. All, or a portion of, the motion applied to the master pistons 110 and 130 may then be "lost" in accordance with control over the trigger valve.

Figure 7:
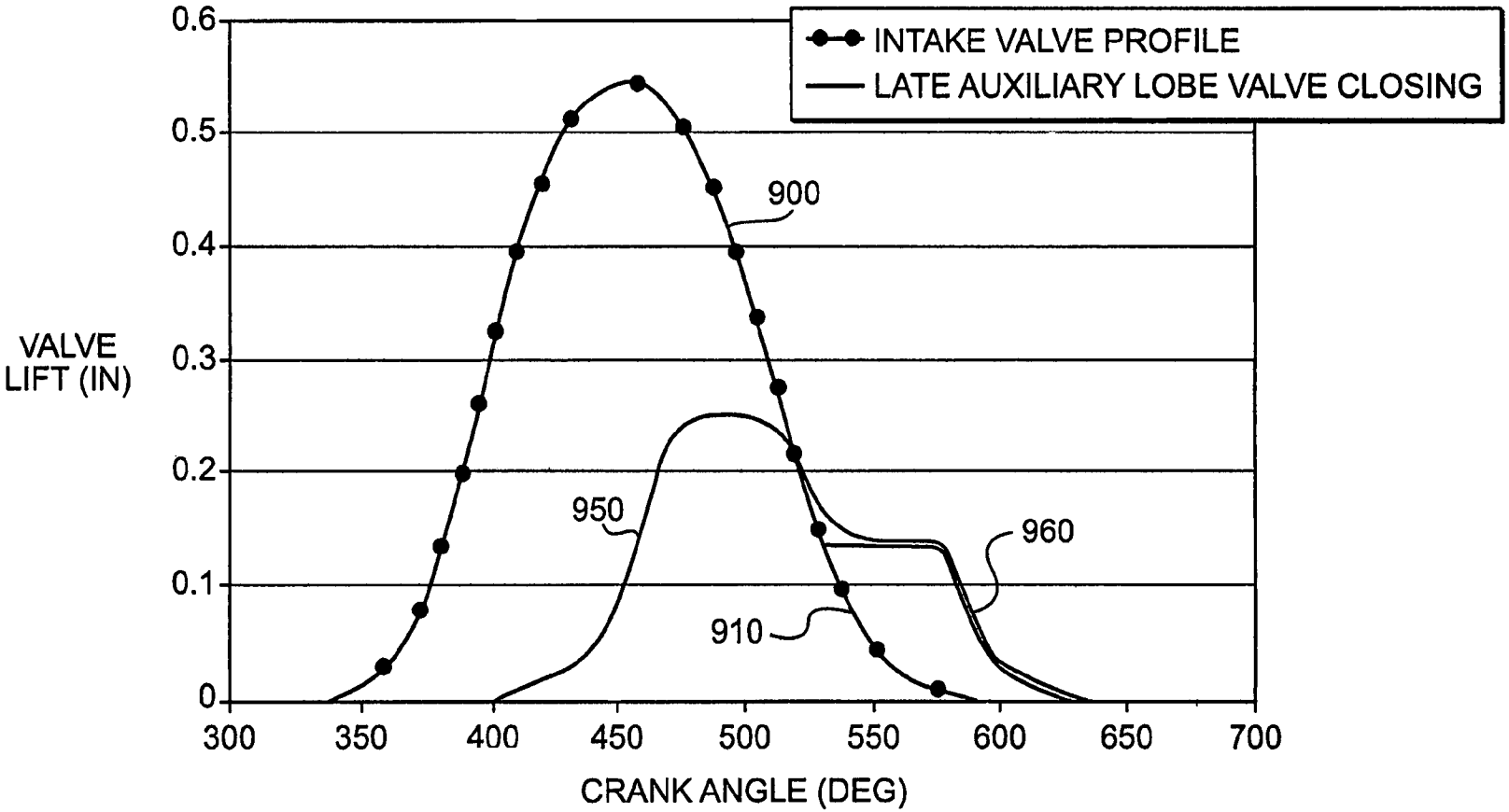
FIG. 7 is a graph of intake engine valve lift versus engine crank angle illustrating variable valve actuation that may be provided in accordance with an embodiment of the present invention.

An example of the variable valve actuation that may be achieved using a system such as those illustrated in FIGS. 1-6 and 8 is shown in the graph of FIG. 7. With reference to FIG. 7, an intake valve may be connected to a valve actuation system including both conventional valve train elements 300 and a lost motion system 100. The valve actuation that is provided by the conventional valve train elements is shown as valve motion 900 (i.e., the main intake valve event), and the valve actuation that may be provided by the lost motion system is shown as valve motion 950 (i.e., the late intake valve closing event). When the lost motion system is fully deactivated, the engine valve experiences only the valve actuation 900, including the closing motion 910, provided by the conventional valve train elements 300. If the lost motion system is fully activated, so that no motion input to it is lost, then the engine valve experiences the beginning portion of the valve actuation 900 provided by the conventional valve train elements 300 to about the 530 degree point, combined with the closing motion 960 provided by the lost motion system. By selectively activating the trigger valve during the closing motion 960 the lost motion system may be controlled to close the engine valve at any point between the normal closing point of about 590 degrees to the latest closing point of about 630 degrees so that variable late intake valve closing may be provided.

It will be apparent to those skilled in the art that various modifications and variations can be made in the construction, configuration, and/or operation of the present invention without departing from the scope or spirit of the invention. For example, where lost motion functionality is not required, it is contemplated that embodiments of the valve seating device 200 may be provided in a system without the lost motion system 100. It is also appreciated that many other variable valve actuations, other than that shown in FIG. 7, may be provided by the various embodiments of the present invention illustrated in FIGS. 1-6.

What is claimed is:

1. A system for actuating at least one engine valve in an internal combustion engine, said system comprising:

a rocker arm disposed on a shaft and the rocker arm having a first end and a second end;

the rocker arm having a first contact surface on the first end, and having a second contact surface, a third contact surface, and a fourth contact surface on the second end;

an engine valve operatively contacting the first contact surface;

a first valve train element operatively contacting the second contact surface;

a lost motion system including a master piston and a slave piston operatively contacting the third contact surface; and a valve seating device operatively contacting the fourth contact surface.

2. The system of claim 1 further comprising a valve seating device provided in said lost motion system.

3. The system of claim 2 wherein said valve seating device is incorporated into the slave piston.

4. The system of claim 1 further comprising:

a second valve train element operatively contacting the lost motion system master piston.

5. The system of claim 4 wherein the first valve train element is a push tube and the second valve train element is a push tube.

6. The system of claim 4 wherein the first valve train element is a cam and the second valve train element is a cam.

7. The system of claim 4 wherein the first valve train element includes means for providing a main intake valve event and the second valve train element includes means for providing a late intake valve closing event.

8. The system of claim 7 wherein the late intake valve closing event may result in the intake valve closing between approximately 590 and 630 crank angle degrees.

9. The system of claim 4 wherein the first valve train element includes means for providing a main engine valve event and the second valve train element includes means for providing an auxiliary engine valve event.

10. The system of claim 9 wherein the auxiliary engine valve event is selected from the group consisting of: a compression release event, a bleeder braking event, an exhaust gas recirculation event, and a brake gas recirculation event.

11. The system of claim 1 further comprising a trigger valve disposed in said lost motion system, said trigger valve being in hydraulic communication with said master piston and said slave piston.

12. The system of claim 11 further comprising a hydraulic fluid accumulator disposed in said lost motion system, said accumulator being in hydraulic communication with said master piston and said slave piston.

13. The system of claim 12 further comprising a second valve train element operatively contacting the lost motion system master piston, and wherein the first valve train element includes means for providing a main intake valve event and the second valve train element includes means for providing a late intake valve closing event.

14. The system of claim 13 wherein the late intake valve closing event may result in the intake valve closing between approximately 590 and 630 crank angle degrees.

15. The system of claim 12 further comprising a second valve train element operatively contacting the lost motion system master piston, and wherein the first valve train element includes means for providing a main engine valve event and the second valve train element includes means for providing an auxiliary engine valve event.

16. The system of claim 15 wherein the auxiliary engine valve event is selected from the group consisting of: a compression release event, a bleeder braking event, an exhaust gas recirculation event, and a brake gas recirculation event.

17. The system of claim 1 further comprising a hydraulic fluid accumulator disposed in said lost motion system, said accumulator being in hydraulic communication with said master piston and said slave piston.

18. The system of claim 1 wherein the master piston and slave piston are provided such that one is slidably disposed in the other.

19. The system of claim 1 wherein the master piston is hydraulically connected to the slave piston by a hydraulic passage.

20. A system for actuating at least one engine valve in an internal combustion engine with valve seating control, said system comprising:

a rocker arm disposed on a shaft and the rocker arm having a first end and a second end;

the rocker arm having a first contact surface on the first end, and having a second contact surface, a third contact surface, and a fourth contact surface on the second end;

an engine valve operatively contacting the first contact surface;

a valve train element operatively contacting the second contact surface;

a housing;

a lost motion system disposed in said housing, said lost motion system including a slave piston operatively contacting the third contact surface;

a valve seating device provided in said lost motion system; and the valve seating device operatively contacting the fourth contact surface.

21. The system of claim 20, wherein said valve seating device is incorporated into said slave piston.

22. A system for actuating at least one engine valve in an internal combustion engine, said system comprising:

a rocker arm having a first contact surface at a first end, and having a second contact surface and a third contact surface at a second end;

an engine valve operatively contacting the first contact surface;

a first valve train element operatively contacting the second contact surface;

a lost motion system including a master piston and a slave piston operatively contacting the third contact surface;

a second valve train element operatively contacting the lost motion system master piston; and wherein the first valve train element is a push tube and the second valve train element is a push tube.

23. A system for actuating at least one engine valve in an internal combustion engine, said system comprising:

a rocker arm having a first contact surface at a first end, and having a second contact surface and a third contact surface at a second end;

an engine valve operatively contacting the first contact surface;

a first valve train element operatively contacting the second contact surface;

a lost motion system including a master piston and a slave piston operatively contacting the third contact surface;

a second valve train element operatively contacting the lost motion system master piston; and wherein the first valve train element includes means for providing a main intake valve event and the second valve train element includes means for providing a late intake valve closing event.

24. The system of claim 23 wherein the late intake valve closing event may result in the intake valve closing between approximately 590 and 630 crank angle degrees.

25. A system for actuating at least one engine valve in an internal combustion engine, said system comprising:

a rocker arm having a first contact surface at a first end, and having a second contact surface and a third contact surface at a second end;

an engine valve operatively contacting the first contact surface;

a first valve train element operatively contacting the second contact surface;

a lost motion system including a master piston and a slave piston operatively contacting the third contact surface;

a second valve train element operatively contacting the lost motion system master piston; and wherein the first valve train element includes means for providing a main engine valve event and the second valve train element includes means for providing an auxiliary engine valve event.

26. The system of claim 25 wherein the auxiliary engine valve event is selected from the group consisting of: a compression release event, a bleeder braking event, an exhaust gas recirculation event, and a brake gas recirculation event.

* * * * *